United States Patent [19]

Tjumanok et al.

[11] Patent Number: 4,813,619

[45] Date of Patent: Mar. 21, 1989

[54] DISINTEGRATOR HAVING GRINDING CHAMBER WITH ROTORS INCLUDING CARRYING DISK WITH GRINDING WHEELS CONCENTRICALLY ARRANGED THEREON

[75] Inventors: Alexei N. Tjumanok; Yaan V. Tamm; Andres I. Saul; Valdeko V. Loopere, all of Tallin, U.S.S.R.

[73] Assignee: Tallinsky Politekhnichesky Institut, Tallin, U.S.S.R.

[21] Appl. No.: 156,922

[22] PCT Filed: Mar. 21, 1986

[86] PCT No.: PCT/SU86/00022

§ 371 Date: Nov. 5, 1987

§ 102(e) Date: Nov. 5, 1987

[87] PCT Pub. No.: WO87/05534

PCT Pub. Date: Sep. 24, 1987

[51] Int. Cl.[4] ..... B02C 13/22

[52] U.S. Cl. ..... 241/80; 241/188 R

[58] Field of Search ..... 241/73, 74, 275, 188 R, 241/188 A, 79.1, 80, 97

[56] References Cited

U.S. PATENT DOCUMENTS

| | | | |
|---|---|---|---|
| 1,822,436 | 9/1931 | Fasting | 241/80 |
| 2,656,988 | 10/1953 | Smith | 241/275 |
| 4,093,127 | 6/1978 | Alberts et al. | 241/56 |
| 4,653,700 | 3/1987 | Tjumanok . | |
| 4,721,259 | 1/1988 | Shagaroua et al. | 241/188 A X |

FOREIGN PATENT DOCUMENTS

| | | |
|---|---|---|
| WO85/02354 | 6/1985 | PCT Int'l Appl. . |
| 297237 | 8/1972 | U.S.S.R. . |
| 938236 | 6/1982 | U.S.S.R. . |

*Primary Examiner*—Mark Rosenbaum

*Attorney, Agent, or Firm*—Burgess, Ryan & Wayne

[57] ABSTRACT

A disintegrator comprises a housing (1) and a grinding chamber (2) accommodating grinding wheels mounted on shafts (9, 10) of electric motors. The peripheral zone of the chamber (2) accommodates inclined plates (13) of a classifier arranged about the circumference so that an annular slot (14) is formed between these plates and a cylindrical portion (3) of the chamber (2) through which the chamber (2) communicates with a separator (15). The separator (15) embraces one of the electric motors (11) and communicates by way of a passage (21) of return flow of air with an air distributor (22) embracing the electric motor (12). The distributor (22) is connected to the chamber (2) by way of annular slot (24) between the plates (13) of the classifier and the last grinding wheel (8) of the rotor. Connected to the separator (15) is a collector (18) of fine fraction of the material. The means for returning coarse fraction of the material has the form of an arcuate guide (29) arranged in close proximity to an opening (30) provided in the side wall (6) of the chamber (2) where through the chamber (2) communicates with the pipe (4) for charging the initial material (5).

4 Claims, 3 Drawing Sheets

DISINTEGRATOR HAVING GRINDING CHAMBER WITH ROTORS INCLUDING CARRYING DISK WITH GRINDING WHEELS CONCENTRICALLY ARRANGED THEREON

FIELD OF THE INVENTION

This invention relates to the art of comminuting materials, and more particularly to a disintegrator.

BACKGROUND OF THE INVENTION

There is known a disintegrator (USSR Inventor's Certificate No. 1,058,130) comprising a housing connected to a grinding chamber accommodating rotors with grinding wheels rotatable by electric motors. Provided between the rotor and housing is a separation zone wherethrough air is blown by means of pressure and suction blades. Connected to the housing is a pipe for evacuating finely ground material and air to a separator having the form of a cyclone with which a passage of return flow of air to the disintegrator communicates. The grinding chamber has an opening into the inlet pipe.

The material is charged through the inlet pipe to the grinding chamber, where it is comminuted by the rotors. Fine fraction of the material is blown off to be conveyed through the pipe for evacuating the fine fraction to the separator, whereas coarse fraction is conveyed through the opening in the grinding chamber to the inlet pipe for regrinding. From the separator air is conveyed along the air flow return passage to the disintegrator.

However, this prior art construction is bulky, and therefore takes much production space both horizontally and vertically. Another disadvantage is that much power is required for conveying material during operation of this disintegrator.

There is also known a disintegrator (U.S. Pat. No. 4,093,127) comprising a housing having inlet and outlet pipes and accommodating a rotor-separator fashioned as a drum with inclined separating plates spaced from one another about the circumference of the peripheral zone of the drum. A passage for discharging finely ground material and air is provided at the outside of the drum.

The material and air are conveyed from the inlet pipe to the rotor-separator. Rotation of the rotor causes the material to roll over, whereby lumps of the material are crushed and comminuted. Simultaneously, the rotor-separator is blown through by air. Particles having a size less than the clearance between the inclined separating plates are carried to the discharge passage and are evacuated through the outlet pipe. The material remains in the drum to complete comminution.

However, this disintegrator suffers from low efficiency of grinding; in addition, the entire unit including the rotor-separator and air feeding system is excessively bulky.

One more disintegrator is known (U.S. Pat. No. 2,656,988) comprising a housing with an inlet pipe accommodating a rotor with grinding blades and a rotor drive. The rotor is enclosed by a plurality of breaking and separating blades spaced from one another. The magnitude of clearance between the blades determines the boundary of material separation. The lower part of the housing accommodates collectors of coarse and finely ground materials with pipes for evacuating such materials, accordingly.

The material delivered for comminution falls onto the grinding blades of the rotor to be thrown to the plurality of the inclined breaking blades. Particles having a size smaller than the clearance between the breaking-separating blades pass therebetween to enter the collector of fine fraction material, whereas the other particles are conveyed to the collector of coarse material.

During operation the clearances between the blades tend to be clogged by the particles, whereby evacuation of the finely ground material becomes complicated. Also, because of only once-through comminution of the material the disintegrator is capable of producing relatively large-size particles as the end product. For reducing them further in size such large-size particles should be conveyed for repeated grinding to result in structural overcomplication of the disintegrator. The clearance between the blades needs also to be reduced thus again promoting clogging of the clearances and making the grinding process less efficient.

There is finally known a disintegrator (International Application PCT/SU No. 84/0060) comprising a housing, a grinding chamber having a cylindrical portion with a pipe for charging the initial material to the grinding chamber, and two side walls. The grinding chamber accommodates rotors made up of carrying disks with grinding wheels mounted on shafts of electric motors. Communicating with the grinding chamber is a passage for evacuating the material from the grinding chamber to the classifier which includes a plurality of inclined plates and is connected by a passage for discharging finely ground material with a cyclone-type separator. Connected to the separator is a passage of return flow of air to the disintegrator, whereas connected to the classifier is a passage for returning coarse fraction of the material to regrinding.

The material is carried with the air through the pipe to the grinding chamber where it is ground by the rotors and fed to the classifier in which the inclined plates act to separate fine fraction and convey it along the passage to the separator. Coarse fraction of the material flows from the classifier along the passage to the inlet pipe for regrinding.

This prior art disintegrator suffers from low efficiency, since after grinding the entire material is mixed and conveyed with air to the classifier for the coarse and fine fractions to be separated. A substantial amount of power is consumed for classification and transport of the fine fraction and air to the separator, and conveying air from the separator back to the disintegrator.

SUMMARY OF THE INVENTION

This invention aims at providing such a disintegrator in which the arrangement of separate parts and units thereof would enable to simplify the disintegrator structurally, reduce it is size, and ensure consumption of a smaller amount of power for comminuting the material with the same efficiency.

The aims of the invention are attained by that in a disintegrator comprising a housing, a grinding chamber having a cylindrical portion with a pipe for charging the initial material to the grinding chamber, and two side walls accommodating rotors including carrying disks with grinding wheels concentrically arranged thereon, the rotors being mounted on shafts of electric motors, a classifier with a plurality of inclined plates, a means for returning coarse fraction of the material to regrinding, a separator of air and fine fraction of the material with which communicates a passage of return flow of air and a collector of fine fraction of the material, according to the invention, the inclined plates of the classifier are arranged about the circumference in the peripheral zone of the grinding chamber at a distance from its cylindrical portion to form an annular slot facilitating communication of the separator of air and fine fraction of the material with the grinding chamber, the separator embracing one of the electric motors and communicating by way of the return flow air passage with an air distributor embracing the other electric motor and communicating with the grinding chamber by way of an annular slot formed by a clearance between the inclined plates of the classifier and the last grinding wheel, the means for returning coarse fraction of the material to regrinding having the form of an arcuate guide arranged in the immediate proximity to an opening made in the side wall of the grinding chamber and through which the grinding chamber communicates with the pipe for charging the initial material.

In order to control fineness of the material being ground, it is advisable that the inclined plates of the classifier be pivotable.

For increasing the production efficiency of the disintegrator, it is advisable to provide it with guide vanes arranged in the annular slot between the inclines plates of the classifier and cylindrical portion of the grinding chamber, and with a suction fan disposed in the separator of air and fine fraction of the material in the immediate proximity to this annular slot and connected to the carrying disk of one of the rotors.

With the same aim in view, it is preferable that the disintegrator be provided with guide vanes arranged in the annular slot and formed by a clearance between the last grinding wheel and inclined plates of the classifier, and with a forced-draught fan arranged in the grinding chamber in the immediate proximity to this annular slot and connected to one of the rotors.

The proposed construction of disintegrator makes it possible to substantially reduce its dimensions and bring down the amount of power required for its operation by 10–15%.

BRIEF DESCRIPTION OF THE DRAWINGS

The invention will now be described in greater detail with reference to a specific embodiment thereof taken in conjunction with the accompanying drawings, in which.

BEST MODE OF CARRYING OUT THE INVENTION

Figure 1:
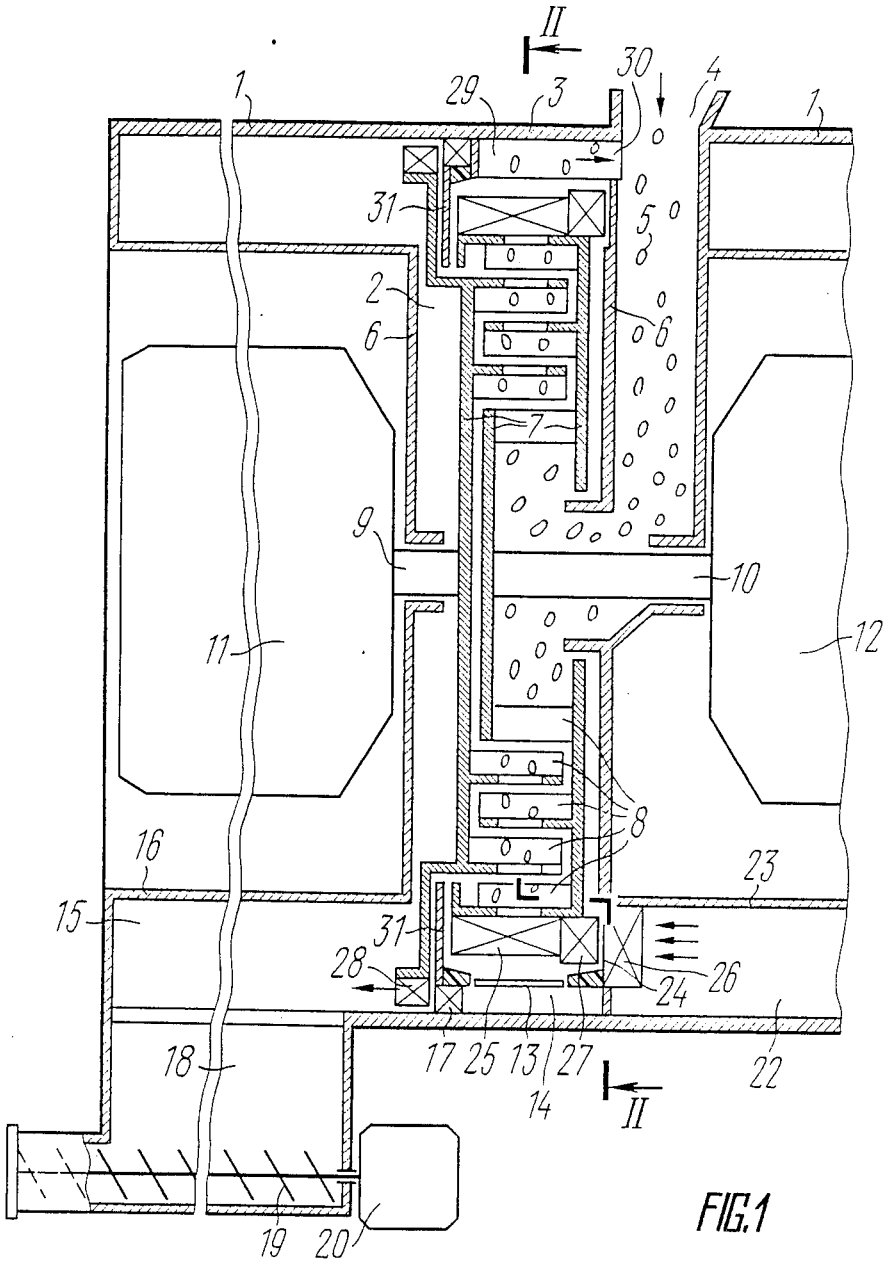
FIG. 1 is a longitudinal sectional view of a disintegrator according to the invention.

The proposed disintegrator comprises a housing 1 (FIG. 1), a grinding chamber 2 having a cylindrical portion 3 with a pipe 4 for charging initial material 5 to the grinding chamber 2, and side walls 6. The grinding chamber 2 accommodates two rotors, each including carrying disks 7 and grinding wheels 8 and mounted on shafts 9 and 10 of electric motors 11 and 12, respectively.

Figure 2:
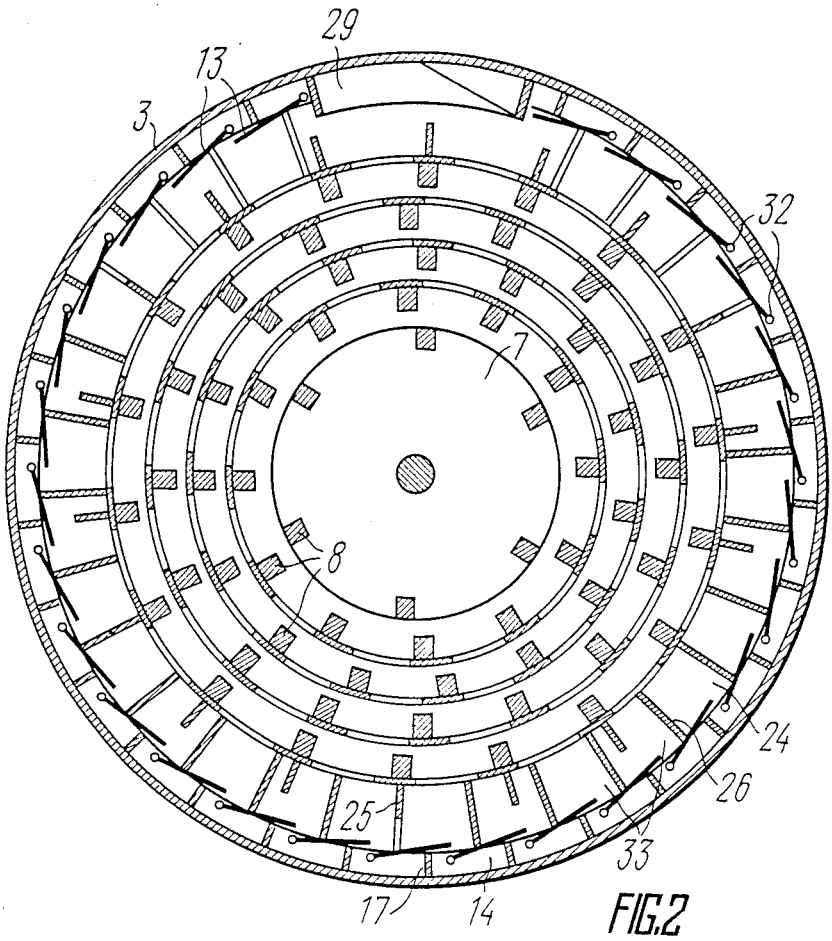
FIG. 2 is a cross-sectional view of the grinding chamber of the proposed disintegrator according to the invention.

The disintegrator also comprises a classifier in the form of a plurality of inclined plates 13 (FIGS. 1 and 2) arranged about the circumference of the peripheral zone of the grinding chamber 2 at a certain distance from its cylindrical portion 3 to form an annular slot 14. Through the slot 14 the grinding chamber 2 communicates with a separator 15 of air and fine material fraction, which embraces the electric motor 11 and is disposed between the housing 1 and a cylinder 16. The annular slot 14 accommodates guide vanes 17 (FIGS. 1 and 2). The lower part of the separator 15 has connected thereto a collector 18 of fine fraction of the material, the bottom portion of which includes a unit for discharging the fine fraction of the material fashioned, for example, as a worm 19 with a drive 20. The separator 15 communicates by way of a passage 21 of return flow of air with an air distributor 22 which embraces the electric motor 12 and is disposed between the housing 1 and a cylinder 23. The distributor 22 communicates with the grinding chamber 2 by way of an annular slot 24 (FIGS. 1 and 2) defined by the clearance between the inclined plates 13 of the classifier and the last grinding wheel 8 provided with ventilation blades 25. The slot 24 accommodates guide vanes 26, whereas the grinding chamber accommodates a forced-draught fan 27 blades of which are disposed in immediate proximity to the slot 24 and which is connected to the carrying disk 7 of the rotor mounted on the shaft 10 of the electric motor 12. Arranged inside the separator 15 is a suction fan 28 the blades of which are disposed in close proximity to the annular slot 14 and which is connected to the carrying disk 7 of the rotor mounted on the shaft 9 of the electric motor 11. The unit for returning large-size fraction of the material for regrinding is fashioned as an arcuate guide 29 secured in immediate proximity to an opening 30 provided in the side wall 6 of the grinding chamber 2 wherethrough it communicates with the pipe 4.

In order to avoid penetration of large-size fraction of the material to the small-size fraction, an annular barrier 31 is provided between the fan 28 and grinding chamber 2. For controlling fineness of the material the inclined plates 13 of the classifier are capable of swinging on hinges 32 to thereby change the width of a clearance 33 between the plates 13.

Figure 3:
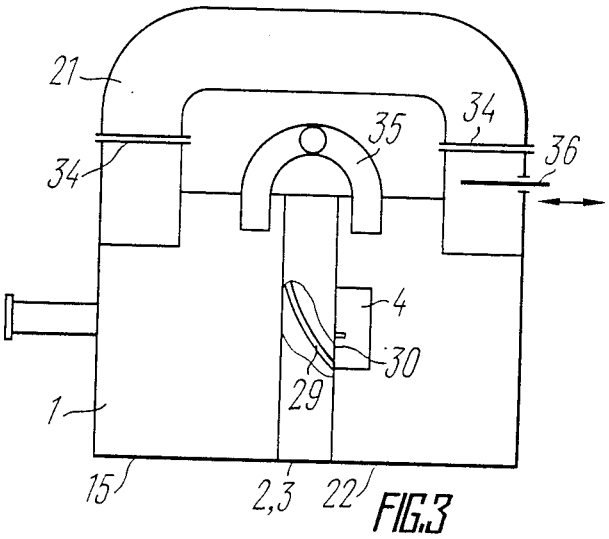
FIG. 3 is a top plan view of the disintegrator according to the invention.

For opening the disintegrator the passage 21 (FIG. 3) is detachable having flanges 34, whereas the housing 1 of the disintegrator is provided with a hinge arrangement 35. A gate plate 36 is further provided for controlling the flow of air in the passage 21.

Figure 4:
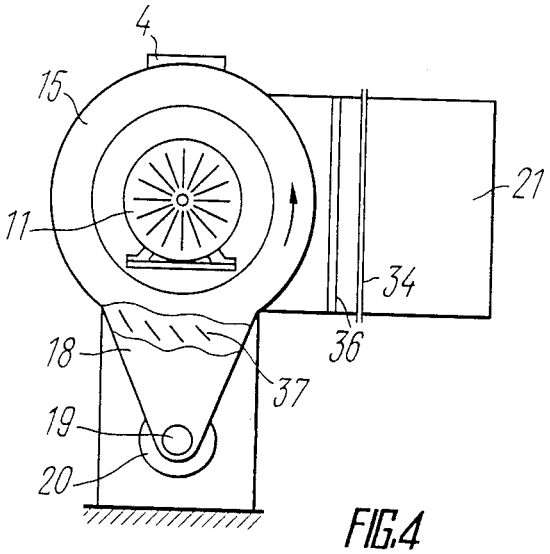
FIG. 4 is a side view of the disintegrator according to the invention.

A flow splitter 37 (FIG. 4) having the form of inclined plates is provided between the separator 15 and collector 18 of fine fraction of the material.

The disintegrator according to the invention operates in the following manner. The initial material 5 (FIG. 1) is conveyed through the pipe 4 to the grinding chamber 2, passes through all the grinding wheels 8, and is conveyed further to the plurality of inclined plates 13 (FIG. 2) of the classifier. The comminuted material slides therealong, whereas uniformity of the flow is ensured by the ventilation blades 25. Simultaneously, the thus moving layer is blown through by a flow of air produced by the rotors of the disintegrator, fans 27, 28 (FIG. 1), and ventilation blades 25. Fine fraction of the material is evacuated through the clearances 33 (FIG. 2) between the inclined plates 13 together with the air, this fine fraction entering the separator 15 (FIG. 1) through the annular slot 14. By virtue of circular movement of the flow produced by the guide vanes 17 and fan 28, the material tends to settle on the walls of the separator 15, slides therealong, and enters the collector 18, wherefrom it is evacuated by the discharge means. Air from the separator 15 is conveyed along the passage 21 (FIG. 3) to the distributor 22 (FIG. 1) to enter the grinding chamber 2 through the annular slot 24. Large-size fraction of the material slides on the inclined plates 13 along the arcuate guide 29 to move through the opening 30 to the pipe 4 and enter the grinding chamber 2 for regrinding.

Reduction in the amount of power to be consumed during comminution is attained by the following. First, through accommodating the classifier in the grinding chamber 2 embracing the rotors; in this zone the density of the mixture is low, and therefore grading the material to size takes place without expending the energy for feeding the material to the classifier. Second, through immediately connecting the separator 15 with the grinding chamber 2 resulting in reduced amount of power consumed for conveying the material. And finally, through reducing the travel path of air.

In addition, this construction of the disintegrator is sufficiently small-size to occupy less production floor area horizontally and vertically.

INDUSTRIAL APPLICABILITY

The invention can be utilized with success for comminuting construction material, in the chemical technology, and for milling grain, particularly for producing alcohol.

We claim:

1. A disintegrator comprising a housing (1), a grinding chamber (2) having a cylindrical portion (3) with a pipe (4) for charging the initial material (5) to a grinding chamber (2) and two side walls (6), and accommodating rotors in the form of carrying disks (7) having arranged concentrically thereon grinding wheels (8) and electric motors (11, 12) mounted on shafts (9, 10), a classifier having a plurality of inclined plates (13), a means for returning large-size fraction of the material for regrinding, a separator (15) of air and fine fraction of the material communicating with a passage (21) of return flow of air and with a collector (18) of the fine fraction of the material, characterized in that the inclined plates (13) of the classifier are arranged about the circumference in the peripheral zone of the grinding chamber (2) at a distance from its cylindrical portion (3) to form an annular slot (14) through which the grinding chamber (2) communicates with the separator (18) of air and fine fraction of the material embracing one of the electric motors (11) and communicating by way of the passage (21) of return flow of air with an air distributor (22) embracing another electric motor (12) and connected with the grinding chamber (2) by way of an annular slot (24) formed by a clearance between the inclined plates (13) of the classifier and last grinding wheel (8), the means for returning large-size fraction of the material for regrinding having the form of an arcuate guide (29) arranged in the immediate proximity to an opening (30) provided in the side wall (6) of the grinding chamber (2) and through which the grinding chamber (2) communicates with the pipe (4) for charging the initial material (5).

2. A disintegrator as claimed in claim 1, characterized in that the inclined plates (13) of the classifier are pivotable.

3. A disintegrator as claimed in claim 1, characterized in that it is provided with guide vanes (17) arranged in the annular slot (14) between the inclined plates (13) of the classifier and cylindrical portion (3) of the grinding chamber (2), and a suction fan (28) disposed in the separator (15) of air and fine fraction of the material in the immediate proximity to this annular slot (14) and connected to the carrying disk (7) of one of the rotors.

4. A disintegrator as claimed in claim 1, characterized in that it is provided with guide vanes (26) arranged in the annular lot (24) and formed by a clearance between the last grinding wheel (8) and inclined plates (13) of the classifier, and a forced-draught fan (27) arranged in the grinding chamber (2) in the immediate proximity to this annular slot (24) and connected to one of the rotors.

* * * * *